US005418119A

United States Patent [19]

Simons

[11] Patent Number: 5,418,119

[45] Date of Patent: May 23, 1995

[54] PHOTOGRAPHIC ELEMENTS FOR PRODUCING BLUE, GREEN AND RED EXPOSURE RECORDS OF THE SAME HUE

[75] Inventor: Michael J. Simons, Middlesex, England

[73] Assignee: Eastman Kodak Company, Rochester, N.Y.

[21] Appl. No.: 199,862

[22] Filed: Feb. 22, 1994

Related U.S. Application Data

[62] Division of Ser. No. 93,504, Jul. 16, 1993, Pat. No. 5,530,664.

[51] Int. Cl.[6] ..... G03C 1/00; G03C 1/46; G03C 1/76; G03C 1/825

[52] U.S. Cl. ..... 430/507; 430/503; 430/504; 430/508; 430/510; 430/513; 430/517

[58] Field of Search ..... 430/503, 504, 507, 508, 430/510, 513, 517

[56] References Cited

U.S. PATENT DOCUMENTS

| | | | |
|---|---|---|---|
| 2,153,617 | 4/1939 | Eggert et al. | 430/513 |
| 4,543,308 | 9/1985 | Schumann et al. | 430/21 |
| 4,777,102 | 10/1988 | Levine | 430/21 |
| 4,788,131 | 11/1988 | Kellogg et al. | 430/394 |

FOREIGN PATENT DOCUMENTS 760775 11/1956 United Kingdom .

OTHER PUBLICATIONS

Research Disclosure, vol. 308, Dec. 1989, Item 308119 (Section VIII, paragraph C).

Research Disclosure, vol. 134, Jun. 1975, Item 13452.

Buhr et al Research Disclosure, vol. 253, May 1985, Item 25330.

*Primary Examiner*—Charles L. Bowers, Jr.
*Assistant Examiner*—J. Pasterczyk
*Attorney, Agent, or Firm*—Carl O. Thomas

[57] ABSTRACT

A photographic element is disclosed comprised of a sequence of superimposed blue, green and red recording silver halide emulsion layer units at least two of which produce images of the same hue upon processing. The photographic element is additionally comprised of, interposed between the two emulsion layer units, an interlayer unit for transmitting to the emulsion layer unit of the two units which is nearer the support, electromagnetic radiation that this emulsion layer unit is intended to record and capable, after processing, of reflecting electromagnetic radiation within at least one wavelength region. The imagewise exposed photographic element can be photographically processed to produce a silver image in each of the emulsion layer units, and can be reflection scanned utilizing reflection from the interlayer unit to provide a first record of the image information in one of the two emulsion layer units and can be reflection or transmission scanned to provide second and third records of the image information in the other two emulsion layer units. The first, second and third records can be compared to obtain separate blue, green and red exposure records.

20 Claims, No Drawings

PHOTOGRAPHIC ELEMENTS FOR PRODUCING BLUE, GREEN AND RED EXPOSURE RECORDS OF THE SAME HUE

This is a division of U.S. Ser. No. 093,504, filed Jul. 16, 1993, now U.S. Pat. No. 5,530,664.

FIELD OF THE INVENTION

The invention is directed to a method of extracting blue, green and red exposure records from an imagewise exposed silver halide photographic element and to a photographic element particularly adapted for use in the method.

BACKGROUND

In classical black-and-white photography a photographic element containing a silver halide emulsion layer coated on a transparent film support is imagewise exposed to light, producing a latent image within the emulsion layer. The film is then photographically processed to transform the latent image into a silver image that is a negative image of the subject photographed. Photographic processing involves developing (reducing silver halide grains containing latent image sites to silver), stopping development, and fixing (dissolving undeveloped silver halide grains). The resulting processed photographic element, commonly referred to as a negative, is placed between a uniform exposure light source and a second photographic element, commonly referred to as a photographic paper, containing a silver halide emulsion layer coated on a white paper support. Exposure of the emulsion layer of the photographic paper through the negative produces a latent image in the photographic paper that is a positive image of the subject originally photographed. Photographic processing of the photographic paper produces a positive silver image. The image bearing photographic paper is commonly referred to as a print.

In classical color photography in its most widely used form the photographic film contains three superimposed silver halide emulsion layer units each containing a different subtractive primary dye or dye precursor, one for recording blue light (i.e., blue) exposure and forming a yellow dye image, one for recording green exposure and forming a magenta dye image, and one for recording red exposure and forming a cyan dye image. During photographic processing developing agent is oxidized in the course of reducing latent image containing silver halide grains to silver, and the oxidized developing agent is employed to form the dye image, usually by reacting (coupling) with a dye precursor (a dye-forming coupler). Undeveloped silver halide is removed by fixing and the unwanted developed silver image is removed by bleaching during photographic processing. This approach is most commonly used to produce negative dye images (i.e., blue, green and red subject features appear yellow, magenta and cyan, respectively). Exposure of color paper through the color negative followed by photographic processing produces a positive color print.

Although widely used this form of classical color photography has evolved highly complicated complementary film and paper constructions. For example, a typical color negative film contains not only a minimum of three different emulsion layer units, but also dye-forming couplers, coupler solvents to facilitate their dispersion, masking couplers to minimize image hue distortions in printing onto color paper, and oxidized developing agent scavengers to avoid formation of unwanted dyes. Not only is the film structure complex, but the optical qualities of the film are degraded by the large quantities of ingredients related to dye image formation and management.

A much simpler film that has enjoyed commercial success in classical color photography is a color reversal film that contains three separate emulsion layer units for separately recording blue, green and red exposures, but contains no dye image forming ingredients. The film is initially processed like a black-and-white photographic film to produce three separate silver images in the blue, green and red recording emulsion layer units. The simplicity of construction has resulted in imaging properties superior to those of incorporated dye-forming coupler color negative films.

The factor that has limited use of these color reversal films is the cumbersome technique required for translating the blue, green and red exposure records into viewable yellow, magenta and cyan dye images. Three separate color developments are required to sequentially form dye images in the blue, green and red recording emulsion layer units. This is accomplished in each instance by rendering the silver halide remaining after black-and-white development developable in one layer and then employing a color developer containing a soluble dye-forming coupler to develop and form a dye image in one of the emulsion layer units. Developed silver is removed by bleaching to leave three reversal dye images in the photographic film.

In each of the classical forms of photography noted above the final image is intended to be viewed by the human eye. Thus, the conformation of the viewed image to the subject image, absent intended aesthetic departures, is the criterion of photographic success.

With the emergence of computer controlled data processing capabilities, interest has developed in extracting the information contained in an imagewise exposed photographic element instead of proceeding directly to a viewable image. It is now common practice to extract the information contained in both black-and-white and color images by scanning. The most common approach to scanning a black-and-white negative is to record point-by-point or line-by-line the transmission of a near infrared beam, relying on developed silver to modulate the beam. Another approach is to address areally the black-and-white negative relying on modulated transmission to a CCD array for image information recording. In color photography blue, green and red scanning beams are modulated by the yellow, magenta and cyan image dyes. In a variant color scanning approach the blue, green and red scanning beams are combined into a single white scanning beam modulated by the image dyes that is read through red, green and blue filters to create three separate records. The records produced by image dye modulation can then be read into any convenient memory medium (e.g., an optical disk). The advantage of reading an image into memory is that the information is now in a form that is free of the classical restraints of photographic embodiments. For example, age degradation of the photographic image can be for all practical purposes eliminated. Systematic manipulation (e.g., image reversal, hue alteration, etc.) of the image information that would be cumbersome or impossible to achieve in a controlled and reversible manner in a photographic element are readily achieved. The stored information can be retrieved from memory to modulate light exposures necessary to recreate the image as a photographic negative, slide or print at will. Alternatively, the image can be viewed as a video display or printed by a variety of techniques beyond the bounds of classical photography—e.g., xerography, ink jet printing, dye diffusion printing, etc.

A number of other film constructions have been suggested particularly adapted for producing photographic images intended to be extracted by scanning:

Kellogg et al U.S. Pat. No. 4,788,131 extracts image information from an imagewise exposed photographic element by stimulated emission from latent image sites of photographic elements held at extremely low temperatures. The required low temperatures are, of course, a deterrent to adopting this approach.

Levine U.S. Pat. No. 4,777,102 relies on the differential between accumulated incident and transmitted light during scanning to measure the light unsaturation remaining in silver halide grains after exposure. This approach is unattractive, since the difference in light unsaturation between a silver halide grain that has not been exposed and one that contains a latent image may be as low as four photons and variations in grain saturation can vary over a very large range.

Schumann et al U.S. Pat. No. 4,543,308 relies upon differentials in luminescence in developed color films to provide an image during scanning. Relying on differentials in luminescence from spectral sensitizing dye, the preferred embodiment of Schumann et al, is unattractive, since luminescence intensities are limited. Increasing spectral sensitizing dye concentrations beyond optimum levels is well recognized to desensitize silver halide emulsions.

Light reflection during imagewise exposure is a recognized phenomenon that is usually unwanted. When exposing light passes through an emulsion layer unit of a silver halide photographic element and is then reflected back so that it passes through the emulsion layer unit twice, the result is an unsharp image and the effect is referred to as halation, since a bright object will often appear to be surrounded by a halo. The common approach to reducing unwanted reflection is to incorporate in a photographic element an antihalation layer that absorbs exposing light after it has passed through the emulsion layer unit or units to prevent reflection. Antihalation layers are removed or decolorized during processing and therefore have no role in viewing the image. Typical antihalation materials are set out in *Research Disclosure*, Vol. 308, December 1989, Item 308119, Section VIII, paragraph C, and their discharge (decolorization or solubilization) is addressed in paragraph D. *Research Disclosure* is published by Kenneth Mason Publications, Ltd., Dudley House, 12 North St., Emsworth, Hampshire P010 7DQ, England.

While exposure reflection is undesirable in reducing image sharpness, it has been used to advantage to increase speed. Yutzy and Carroll U.K. Patent 760,775 disclose using titania or zinc oxide in an undercoat beneath a silver halide emulsion layer unit to reflect from 40 to 90 percent of the light received. *Research Disclosure*, Vol. 134, June 1975, Item 13452, discloses increasing photographic sensitivity by incorporating within or directly beneath an emulsion layer small reflective particles that scatter light. In FIG. 1 a relationship between particle size and light scattering is provided. Buhr et al *Research Disclosure*, Vol. 253, May 1985, Item 25330, discusses the transmission and reflection relationship between the thickness of tabular silver halide grains and the wavelength of light used for exposure.

SUMMARY OF THE INVENTION

This invention has as its purpose to provide a method of extracting from a silver halide color photographic element independent image records representing imagewise exposures to the blue, green and red portions of the visible spectrum without necessarily forming dye images. More particularly, the invention is concerned with achieving this objective using color photographic film and photographic processing that are simplified as compared to that required for classical color photography.

The present invention eliminates any need for dye image forming features in the photographic element construction. Further, the processing of the photographic elements can be comparable to the simplicity of classical black-and-white photographic processing. Equally as important is that the simplifications can be realized by remaining within the bounds of proven film construction, processing and scanning capabilities.

In one aspect the invention is directed to a method of obtaining from an imagewise exposed photographic element separate records of the imagewise exposure to each of the blue, green and red portions of the spectrum comprising (a) photographically processing an imagewise exposed photographic element comprised of a support and, coated on the support, a sequence of superimposed blue, green and red recording silver halide emulsion layer units at least two of which produce images of the same hue upon processing, and (b) obtaining separate blue, green and red exposure records from the photographic element, wherein (c) the photographic element is additionally comprised of, interposed between the said two emulsion layer units an interlayer unit for transmitting to the emulsion layer unit of said two units which is nearer the support, electromagnetic radiation that this emulsion layer unit is intended to record and capable, after processing, of reflecting electromagnetic radiation within at least one wavelength region, (d) the imagewise exposed photographic element is photographically processed to produce a silver image in each of the emulsion layer units, (e) the photographic element is reflection scanned utilizing reflection from the interlayer unit to provide a first record of the image information in one of said two emulsion layer units and is reflection or transmission scanned to provide second and third records of the image information in the other two emulsion layer units, and (f) the first, second and third records are compared to obtain separate blue, green and red exposure records.

In another aspect this invention is directed to a silver halide photographic element capable of being scanned for image information following imagewise exposure and photographic development and fixing comprised of a support and, coated on the support, a sequence of superimposed blue, green and red recording silver halide emulsion layer units at least two of which produce images of the same hue upon processing, one of the emulsion layer units forming a first emulsion layer unit in the sequence coated nearest the support, another of the emulsion layer units forming a last emulsion layer unit in the sequence coated farthest from the support, and an intermediate emulsion layer unit located between the first and last emulsion layer units, and an interlayer unit coated between the two emulsion layer units capable of transmitting to each emulsion layer unit nearer to the support electromagnetic radiation this emulsion layer unit is intended to record, the interlayer unit, following photographic development and fixing, being reflective in a scanning wavelength region.

DESCRIPTION OF PREFERRED EMBODIMENTS

The invention is directed to a photographic element particularly constructed to permit blue, green and red exposure records to be extracted by scanning and to a method of obtaining from the photographic element after imagewise exposure the blue, green and red exposure records. The photographic element is developed to produce silver images corresponding to blue, green and red exposures and fixed to remove silver halide grains in the exposure recording emulsion layer units that are not reduced to silver. Extraction and differentiation of the blue, green and red exposure image information is made possible by utilizing interlayer units in the photographic element to obtain two reflection scan channels of information and by obtaining a third channel of information by a scan that penetrates all of the emulsion layer units and interlayer units (hereafter also referred to as an overall scan).

In every instance reflection from one interlayer unit is recorded during one of the reflection scanning steps. The reflection from the interlayer unit is modulated by developed silver in the exposure recording emulsion layer unit or units the scanning beam penetrates. The use of a reflective interlayer unit has the advantage that the scanning beam twice penetrates the same emulsion layer unit or units, thereby enhancing the modulation of the beam as compared to the modulation obtained by a single penetration.

In one preferred form of the invention the remaining interlayer unit is also reflective and both reflection scans rely on reflection by the interlayer units as described above.

In an alternative form of the invention one of the interlayer units can be a reflective interlayer unit as described above while the remaining interlayer unit is an absorptive interlayer unit. When an absorptive interlayer unit is employed, the reflection that is recorded is the low, but detectable level of reflection provided by the developed silver. The role of the absorptive interlayer unit is to provide a nonreflective background for scanning.

An important point to notice is that, although one interlayer unit is reflective and one interlayer unit is reflective or absorptive during scanning, each in at least one wavelength region, both of the interlayer units must be capable of specularly transmitting radiation to the underlying emulsion layer unit or units during imagewise exposure. Further, both of the interlayer units must be penetrable by the scanning beam used for overall scanning through all emulsion layer units and interlayer units.

When the light transmission requirements of the interlayer units are taken into account it is apparent that each reflective or absorptive interlayer unit must be capable of specularly transmitting light within the spectral wavelength region or regions which underlying emulsion layer unit or units are intended to record. Each interlayer unit must be capable of transmitting light within at least one common wavelength region during overall scanning. Each interlayer unit must also be capable of reflecting or absorbing a scanning beam during reflection scanning.

Both the light transmission and absorption requirements of the absorptive interlayer unit can be readily achieved by dissolving or dispersing an appropriate dye or dye precursor in a conventional photographic vehicle. A simple construction is to employ a dye in the absorptive interlayer unit that exhibits minimal or near minimal absorption of light during imagewise exposure in the wavelength region or regions that the underlying emulsion layer unit or units are intended to record and that exhibits peak or near peak absorption in another wavelength region that is used for scanning. Another alternative is to employ a dye precursor that absorbs during imagewise exposure little, if any, of the light which the underlying emulsion layer unit or units are intended to record, with the dye precursor being converted after imagewise exposure to a dye exhibiting an absorption peak in a wavelength region in which reflection scanning is conducted. Overall scanning can be conducted in a wavelength region within which the dye exhibits minimal or near minimal absorption. Stated in a more quantitative way, the dye employed, whether preformed or formed in situ, is chosen to exhibit a half-peak absorption bandwidth that occupies the spectral region within which absorption for reflection scanning is needed.

Achieving the light absorption requirements of the absorptive interlayer unit is compatible with retaining the specularly transmissive and non-reflective characteristics of conventional photographic element interlayer unit constructions, since a wide variety of dyes and dye precursors are available that have real component refractive indices essentially similar to the photographic layer vehicle in which they are dissolved or dispersed (e.g., preferably differing by $<\pm 0.2$, most preferably $<\pm 0.1$).

A refractive index contains a real component, herein also referred to as a diffraction representing component, (n) that is related to light defraction and an imaginary component, herein also referred to as an absorption representing component, (ik) that is related to light absorption. For simplicity of expression subsequent references are to refractive index with the parenthetic term (n) and/or (ik) being used to indicate the component being discussed. Nonabsorbing materials (e.g., white and transparent materials) have no significant absorption representing component (ik).

Given the performance criteria above the selection of photographic vehicles, dyes and dye precursors for forming the light absorptive interlayer unit can be readily achieved by those familiar with silver halide photographic element construction. Conventional photographic vehicles are illustrated by *Research Disclosure*, Vol. 308, December 1989, Item 308119, Section IX, the disclosure of which is here incorporated by reference. Hydrophilic colloids, particularly gelatin and gelatin derivatives are preferred vehicle materials. The dye precursors are preferably selected from among conventional dye-forming couplers, such as those set out in Item 308119, Section VII, here incorporated by reference. Any preformed dye that remains stable through photographic development and fixing can be employed. Such dyes include, but are not limited to, the types of dyes, typically azo dyes, that are formed by coupling reactions (e.g., the type of dye that is conventionally formed during color development can be used as a preformed dye). To avoid refractive index (n) mismatches and hence light scattering it is preferred to avoid microcrystalline dyes in constructing the absorptive interlayer unit.

To provide an interlayer unit that is efficiently reflective it is necessary that the reflection scanning beam encounter a phase boundary of two media whose refractive indices (n) differ by >0.2, preferably at least 0.4 and optimally at least 1.0. The simplest way of satisfying this requirement is to create a two phase interlayer unit in which a discrete phase having a refractive index ($n_d$) is dispersed in a continuous phase having a refractive index ($n_c$), where the difference between $n_d$ and $n_c$ is >0.2, preferably ≧0.4 and optimally ≧1.0. The continuous phase preferably takes the form of a conventional photographic vehicle noted above. Gelatin, a typical photographic vehicle with a typical refractive index, is disclosed by James *The Theory of the Photographic Process*, 4th Ed., Macmillan, New York, 1977, p. 579, FIG. 20.2, to have a refractive index (n) ranging from 1.55 to 1.53 within the visible spectrum. Gases have refractive indices (n) of 1.0. One technique for creating a reflective interlayer unit is to disperse gas discretely in the interlayer unit. This can easily be accomplished by incorporating conventional hollow beads in a photographic vehicle. Since organic polymers generally and those commonly used to form hollow beads in particular have refractive indices that differ from that of gelatin by <±0.1, it is apparent that the >0.2 and preferably ≧0.4 refractive index (n) difference between the gas and the surrounding bead walls required for efficient reflection is readily achieved. When inorganics are employed for bead construction, even larger refractive index (n) differences are available.

In a simpler construction the discrete phase can be provided by solid inorganic particles. A wide variety of inorganic particles compatible with silver halide photographic elements are available having a refractive index (n) of greater than 1.0 and, more typically, greater than 2.0. For example, Marriage U.K. Patent 504,283, Apr. 21, 1939, the disclosure of which is here incorporated by reference, discloses mixing with silver halide emulsions inorganic particles having refractive indices of "not less than about 1.75." Marriage discloses the oxide and basic salts of bismuth, such as the basic chloride or bromide or other insoluble bismuth compounds (refractive indices, n, about 1.9); the dioxides of titanium (n=2.7), zirconium (n=2.2), hafnium or tin (n=2.0), calcium titanate (n=2.4), zirconium silicate (n=1.95), and zinc oxide (n=2.2) as well as cadmium oxide, lead oxide and some white silicates. Yutzy and Carroll U.K. Patent 760,775, cited above and here incorporated by reference, also discloses barium sulfate (baryta). It is also recognized that silver halide grains are capable of providing the refractive index (n) differences required for reflection.

A number of approaches are available for providing an interlayer unit or interlayer units satisfying scanning reflectance requirements as well as the requirement of substantially specular transmission during imagewise exposure and during the overall scan.

A starting point is to recognize that the silver halide emulsions used for photographic imaging contain grains that exhibit significant light scattering. The light scattering of latent image forming silver halide grains as compared to Lippmann emulsions, which have grains too small for useful latent image formation, typically 0.05 micrometer (μm), is well known. It is possible to employ an interlayer unit that is as specularly transmissive as a conventional silver halide emulsion layer while at the same time obtaining reflectances that exceed minimum requirements for scanning. As discussed in detail below, it is in fact possible to employ in the interlayer unit silver halide grains for light scattering that are capable of remaining after fixing has removed silver halide grains from the emulsion layer units used for recording imagewise exposure. While it is generally preferred that a minimum reflection efficiency of about 10 percent be exhibited by each reflective interlayer unit, it is recognized that increasing the reflection scanning beam intensity can be used to compensate for reflection inefficiencies.

To improve transmission and/or reflection characteristics of a reflective interlayer unit wavelength regions for exposure, overall scanning and reflection scanning can be selected such that increased refractive index (n) differences in the region of reflection scanning are greater than refractive index (n) differences in wavelength regions intended to transmit imagewise exposure and/or overall scanning light. This is possible because refractive indices vary as a function of wavelength. For example, James, FIG. 20.2, noted above, plots the refractive indices (n) of AgCl, AgBr and AgI relative to the refractive index (n) of gelatin over the visible spectrum, showing that the differences decrease with increasing wavelengths. This suggests performing the overall scan in the infrared region of the spectrum and performing the reflection scan in the blue region of the spectrum when silver halide grains are relied upon for the refractive index (n) difference in the reflective interlayer unit. Although different wavelength region selections may be dictated, the same principles apply to other discrete phase reflective interlayer unit materials. Scanning wavelength selections as described are fully compatible with other approaches for rationalizing reflection and transmission characteristics.

An approach that is effective to improve the specularity of transmission during imagewise exposure through the interlayer unit relied upon for reflection during scanning is to form the discrete phase after imagewise exposure has occurred and before scanning. For example, the formation of titania particles in situ during photographic processing under alkaline conditions, which are required for development, in a photographic element containing titanyl oxalate is taught in *Research Disclosure*, Vol. 111, July 1973, Item 11128, the disclosure of which is here incorporated by reference. The metal salt of the organic acid as initially coated exhibits a refractive index approximating that of the photographic vehicle in which it is coated, whereas the subsequently formed titania has a refractive index (n) of >2.0. Additionally, Marriage U.K. Patent 504,283, incorporated by reference above, discloses similar procedures for forming the reflective particles within the emulsion layers. Although Marriage contemplates forming the particles before imagewise exposure, the same principles can be used to form the particles after imagewise exposure.

It is also possible to employ wavelength dependent effects to maximize or minimize reflection within a selected wavelength region. By controlled dimensional choices of the particles forming the discrete phase of the reflective layer reflection can be maximized or minimized in a selected wavelength region. Although reflection maxima and minima have been observed with particles of many different compositions, the most convenient particles to employ in photographic element construction are silver halide grains, since controlling the size, size-frequency distribution (dispersity) and shape of silver halide grains has been extensively studied. Grain dispersity is often characterized using the terms "monodispersed" or "polydispersed". The latter term typically refers to a broad log normal (Gaussian) size-frequency distribution of grains and is here applied to any grain size distribution that is not monodispersed. The term "monodispersed" refers to a more restricted size-frequency distribution and is typically and herein employed to indicate a size-frequency distribution that exhibits a coefficient of variation (COV) based on grain size (equivalent circular diameter or ECD) of less than 20 percent, where $COV_{ECD}$ is the standard deviation of the grain size distribution divided by the mean grain ECD and multiplied by 100. The equivalent circular diameter of a grain is the diameter of a circle having the same projected area as the grain.

As demonstrated by *Research Disclosure*, Item 13452, cited above and here incorporated by reference, monodispersed nontabular silver halide grains exhibit well defined reflectance maxima in the visible region of the spectrum when mean grain sizes (ECD's) are in the range of from 0.1 to 0.6 μm. For example, to obtain maximum reflectance in the blue region of the spectrum monodispersed nontabular silver halide grains having a mean ECD in the range of from about 0.1 to 0.3 μm represent an excellent choice. These grains exhibit relatively low levels of reflectance in the green, red and near infrared regions of the spectrum. For maximum red reflectance monodispersed nontabular silver halide grains having a mean ECD in the range of from about 0.5 to 0.8 μm represent an excellent choice. Monodispersed nontabular silver halide grains of intermediate ECD's ranging from 0.3 to 0.5 μm can be selected from maximum green reflectance.

Another approach for constructing a spectrally selective reflective interlayer unit is to employ as the discrete particulate phase silver halide grains wherein greater than 90 percent of the total grain projected area is accounted for by tabular grains having a mean ECD greater than 0.4 μm and a mean tabular grain thickness (t) in the range of from 0.07 to 0.2 μm and a tabular grain coefficient of variation based on thickness (COVt) of less than 15 percent. Within these selection criteria tabular grains with mean thicknesses in the range of from about 0.12 to 0.20 μm exhibit maximum levels of blue reflectance while exhibiting minimal reflectance in the green or red region of the spectrum. Tabular grains with mean thicknesses in the range of from about 0.10 to 0.12 μm exhibit maximum reflectances in the red region of the spectrum with significantly lower reflectances in the green region of the spectrum. Tabular grains with mean thicknesses in the range of 0.07 to 0.10 μm exhibit maximum reflectances in the red and green regions of the spectrum. Tabular grain emulsions satisfying these selection criteria and their preparation are disclosed by Nakamura et al U.S. Pat. Nos. 5,096,806 and Tsaur et al 5,147,771, 5,147,772, 5,147,773 and 5,171,771, the disclosures of which are here incorporated by reference.

To rely on silver halide grains to reflect light during reflection scanning it is, of course, necessary to employ grains that are capable of remaining in the photographic element following photographic development and fixing. Development is required to form an image. Fixing is undertaken to remove undeveloped silver halide grains from the exposure recording emulsion layer units, thereby avoiding unwanted reflections from within these layers during overall scanning. Although it is possible that fixing could be eliminated by selection of all the silver halide grain populations in the photographic element to satisfy the optical criteria required for efficient scanning, it is preferred to remove the grain populations of the image recording emulsion layer units before scanning, thereby allowing the full range of image recording emulsion layer unit constructions employed in conventional multicolor photographic elements.

For photographic imaging cubic crystal lattice silver halide grains are almost universally employed for latent image formation. (The cubic crystal lattice should not be confused with the overall grain shape, which may be but most frequently is not cubic.) Silver ions in combination with all relative proportions of chloride and bromide ions form cubic crystal lattices. A minor amount of iodide ions, ranging up to about 40 mole percent for silver bromoiodide emulsions, can be accommodated within the cubic crystal lattice.

High iodide (>90 mole percent iodide, based on silver) silver halide grains (typically available in the crystalline forms of β and γ phase silver iodide) exhibit solubilities that are approximately two orders of magnitude lower than those of silver bromide and approximately four orders of magnitude lower than those of silver chloride. Since high iodide grains are known to respond to development only under a few selected conditions and are much less soluble than latent image forming cubic crystal lattice grains, high iodide grains represent one preferred grain choice for construction of the reflective interlayer units.

Another approach is to employ cubic crystal lattice silver halide grains that are surface passivated (i.e., resistant to development and fixing) in the reflective interlayer units. Surface passivation can be achieved by modifying the grain or its surface boundary to prevent development and fixing. Grains that form internal latent images are nondevelopable in a surface developer (a developer lacking a significant level of solvent or iodide ion), and this represents one available approach to preventing development. Another well known technique for preventing the photographic response of a silver halide grain is to adsorb a desensitizer to its surface. Examples of dyes that desensitize negative-working silver halide emulsions are set in *Research Disclosure*, Item 308119, cited above, Section IV., subsection A, paragraph G, while non-dye desensitizers are disclosed in Section IV, sub-section B, the disclosures of which are here incorporated by reference. Shelling cubic crystal lattice silver halide grains with silver iodide represent an effective approach to surface passivation. Surface passivation can also be achieved by adsorbing to the grain surfaces carbazole, tetraalkyl quaternary ammonium salts containing at least one long (>10 carbon atoms) chain alkyl group, a cyclic thiourea or bis[2-(5-mercapto)-1,3,4-thiadiazolyl]sulfide, based on solubilization resistance to alkali thiosulfate fixing, with and without light exposure, reported by A. B. Cohen et al, "Photosolubilization of Silver Halides II. Organic Reactants", *Photographic Science and Engineering*, Vol. 9, No. 2, March-April 1965, pp. 96–103, the disclosure of which is here incorporated by reference. Because the adsorbed species relied upon for surface passivation adsorb tightly to the grain surfaces and exhibit low solubilities (i.e., silver salt solubility product constants $<10^{-12}$ and preferably less than $10^{-14}$), it is possible to surface passivate the interlayer unit silver halide grains without objectionably affecting the photographic performance of the silver halide grains in the image recording emulsion layer units.

It is, of course, recognized that the discrete phase of the reflective interlayer unit, though carefully selected to satisfy all of the criteria set forth above, may nevertheless be unattractive for use if it absorbs a high percentage of light in the wavelength region of reflection scanning. For example, developed silver exhibits a refractive index (n) of 0.075 and therefore satisfies the preferred refractive index (n) difference of ≧0.4 when dispersed in gelatin. However, the absorption related component (ik) of the refractive index in the visible spectrum (400 to 700 nm) of silver is quite high, as is to be expected, since it appears black. The absorption related component (ik) of the refractive index of silver ranges from 2 to 4.6 in the visible spectrum. While it is possible to construct a reflective interlayer unit of any material that exhibits a reflection distinguishably larger than the low reflectivity of imagewise developed silver, it is preferred to choose discrete phase materials of low absorptions in reflection scanning wavelength regions. It is generally preferred that the absorption related component (ik) of the refractive index of discrete phase components of the reflective interlayer units be less than 0.01 in the wavelength region of reflection scanning.

In Table I below the diffraction related (n) and absorption related (ik) components of the refractive index of discrete phase materials preferred for use in the reflective interlayer units as well as those of silver are set out.

TABLE I

| Discrete Phase | n | ik | Wavelengths (nm) |
|---|---|---|---|
| $TiO_2$ | 2.6–2.9 | <0.001 | 400–700 |
| $BaSO_4$ | 1.64 | <0.001 | 400–700 |
| AgCl | 2.05–2.1 | <0.001 | 400–700 |
| AgBr | 2.22–2.38 | <0.005 | 400–700 |
| AgI | 2.15–2.3 | 0.005 | 450–700 |
| Ag° | 0.075 | 2–4.6 | 400–700 |

It is, of course, possible to utilize light absorption by a reflective interlayer unit to advantage. For example, if the reflective interlayer unit overlies one or more emulsion layer units provided to record green or red light exposures but also exhibiting significant unwanted native sensitivity to blue light and if the interlayer unit is reflection scanned outside the blue region of the spectrum, choosing a reflective interlayer unit that absorbs blue light is advantageous in protecting the underlying emulsion layer unit or units from unwanted blue exposure and does not diminish the reflectivity of the interlayer unit when scanned outside the blue region of the spectrum. Silver iodide and silver bromoiodide are examples of discrete phase choices for the interlayer unit. Referring to Table I above, silver iodide is noted to have a low absorption related component in the green and red (500 to 700 nm) regions of the spectrum. However, the absorption related component (ik) of the refractive index of silver iodide rises steeply in shifting toward wavelengths of <450 nm.

In the discussion above the reflective interlayer unit has been described as being unitary—that is, of the same composition throughout its thickness. In one preferred form of the invention the reflective interlayer unit is a composite interlayer unit comprised of two sub-layers, one sub-layer being relied upon for reflection and the second being relied upon absorption. The reflective sub-layer can be identical to any of the unitary reflective interlayer units previously described. This sub-layer is located to receive light during reflection scanning prior to the absorptive sub-layer. The absorptive sub-layer can be constructed as described above in connection with the absorptive interlayer units and is chosen to absorb light in the wavelength region in which the reflective sub-layer reflects light during reflection scanning. Although the absorptive sub-layer can perform other useful functions, a primary function that the absorptive sub-layer performs is to enhance the quality of the image information obtained during the reflection scan utilizing reflection from the reflective sublayer. This is accomplished by minimizing or eliminating penetration of the reflecting interlayer unit by the reflection scanning beam. If a portion of the reflection scanning beam penetrates the reflective interlayer unit, it may be reflected at one or more underlying surfaces and returned to the reflection scan detector to degrade the image record sought to be determined. Except for the additional capability of absorbing light from the reflection scanning beam that is not reflected the composite reflective interlayer unit is identical in its performance properties to the unitary reflective interlayer unit elsewhere described.

The basic features of the invention can be appreciated by considering the construction and use of a multicolor photographic element satisfying the following structure:

| Structure I |
|---|
| 3rd Emulsion Layer Unit |
| 2nd Interlayer unit |
| 2nd Emulsion Layer Unit |
| 1st Interlayer unit |
| 1st Emulsion Layer Unit |
| Photographic Support |

The first, second and third emulsion layer units are each chosen to record imagewise exposure in a different one of the blue, green and red portions of the spectrum. Each emulsion layer unit can contain a single silver halide emulsion layer or can contain a combination of silver halide emulsion layers for recording exposures within the same region of the spectrum. It is, for example, common practice to segregate emulsions of different imaging speed by coating them as separate layers within an emulsion layer unit. The emulsion layer units can be of any convenient conventional construction. In a specifically preferred form the emulsion layer units correspond to those found in conventional color reversal photographic elements lacking an incorporated dye-forming coupler—i.e., they contain negative-working silver halide emulsions, but do not contain any image dye or image dye precursor.

The first interlayer unit interposed between the first and second emulsion layer units is constructed to transmit electromagnetic radiation that the first emulsion layer unit is intended to record and to absorb or reflect after photographic processing scanning radiation within at least one wavelength region. Similarly, the second interlayer unit interposed between the second and third emulsion layer units is constructed to transmit electromagnetic radiation that the first and second emulsion layer units are intended to record and to absorb or reflect after photographic processing scanning radiation within at least one wavelength region. One or both of the interlayer units reflects scanning radiation.

When the emulsion layer units intended to record minus blue (green or red) lack sufficient native blue sensitivity to require protection from blue light during imagewise exposure, six coating sequences of blue, green and red recording emulsion layer units are possible. Assigning the following descriptors:

IL1=first interlayer unit,
IL2=second interlayer unit,
B=blue recording emulsion layer unit,
G=green recording emulsion layer unit,
R=red recording emulsion layer unit, and
S=support, all of the following layer order sequences are contemplated: B/IL2/G/IL1/R/S, B/IL2/R/IL1/G/S, G/IL2/R/IL1/B/S, R/IL2/G/IL1/B/S, G/IL2/-B/IL1/R/S and R/IL2/B/IL1/G/S. Silver chloride and silver chlorobromide emulsions exhibit such negligibly low levels of native blue sensitivity that all conventional emulsions of these grain compositions can be employed without taking steps to protect the green or red recording emulsion layer units of these silver halide compositions from blue light exposure. Kofron et al U.S. Pat. No. 4,439,520 has demonstrated that adequate separation of blue and minus blue exposures can be achieved with tabular grain silver bromide or bromoiodide emulsions without protecting the minus blue recording layer units from blue light exposure.

The transmission and absorption or reflection characteristics required for the first and second interlayer units during imagewise exposure can now be appreciated by considering the layer order sequences individually. Although imagewise exposure through the support of the photographic elements is in theory possible, the descriptions that follow are based on exposing radiation first striking the third emulsion layer unit, since opaque and antihalation layer containing supports preclude exposure through the support in most preferred photographic element constructions.

(LS-1)

B/IL2/G/IL1/R/S

In this layer sequence IL1 must be capable of transmitting red light and IL2 must be capable of transmitting green and red light during imagewise exposure. When G and R exhibit negligible native blue sensitivity, there is no requirement that IL1 or IL2 be capable of absorbing light of any wavelength during imagewise exposure. When G and R contain silver bromide or bromoiodide emulsions, it is preferred that at least IL2 and, most preferably, both IL1 and IL2 be capable of absorbing blue light during imagewise exposure.

(LS-2)

B/IL2/R/IL1/G/S

In this layer sequence IL1 must be capable of transmitting green light, otherwise the description above for LS-1 is fully applicable.

(LS-3)

G/IL2/R/IL1/B/S

In this layer sequence IL1 must be capable of transmitting blue light and IL2 must be capable of transmitting blue and red light during imagewise exposure. In this arrangement G exhibits negligible native blue sensitivity. When R exhibits negligible native blue sensitivity, there is no requirement that IL2 be capable of absorbing light of any wavelength during imagewise exposure. When R contains a silver bromide or bromoiodide emulsion, it is preferred that IL2 be capable of absorbing blue light during imagewise exposure.

(LS-4)

R/IL2/G/IL1/B/S

In this layer sequence the G and R silver halide selection criteria are reversed from those described for LS-3 to reflect the interchanged positions of these emulsion layer units and IL2 must transmit green and blue light, but otherwise the description above for LS-3 is fully applicable.

(LS-5)

G/IL2/B/IL1/R/S

In this layer sequence IL1 must be capable of transmitting red light and IL2 must be capable of transmitting blue and red light during imagewise exposure. In this arrangement G exhibits negligible native blue sensitivity. When R exhibits negligible native blue sensitivity, there is no requirement that IL1 be capable of absorbing light of any wavelength during imagewise exposure. When R contains a silver bromide or bromoiodide emulsion, it is preferred that IL1 be capable of absorbing blue light during imagewise exposure.

(LS-6)

R/IL2/B/IL1/G/S

In this layer sequence IL1 must be capable of transmitting green light and IL2 must be capable of transmitting blue and green light during imagewise exposure. In this arrangement R exhibits negligible native blue sensitivity. When G exhibits negligible native blue sensitivity, there is no requirement that IL1 be capable of absorbing light of any wavelength during imagewise exposure. When G contains a silver bromide or bromoiodide emulsion, it is preferred that IL1 be capable of absorbing blue light during imagewise exposure.

Following imagewise exposure the photographic element is photographically processed to develop silver halide in the first, second and third emulsion layer units to silver as a function of latent image formation in the emulsion grains. Following development residual silver halide is removed from the first, second and third emulsion layer units by any convenient conventional non-bleaching fixing technique. As previously discussed, if one or both of the interlayer units contains silver halide to provide light reflection during scanning, this silver halide differs from that in the interlayer units to allow the interlayer unit silver halide to remain after silver halide in the emulsion layer units is solubilized during fixing.

At the conclusion of photographic processing the element contains three separate silver images, a silver image representing a blue exposure record, a silver image representing a green exposure record, and a silver image representing a red exposure record. All of the silver images are of essentially the same hue.

One of the significant features of this invention is the scanning approach used to obtain three differentiated blue, green and red image records. It has been discovered that two reflection scans and a third overall scan that can be either a reflection or transmission scan, depending on the element support structure, can be selected to produce three different scan records from which the blue, green and red image records can be obtained.

The overall scan and one or both of the reflection scans are conducted within spectral wavelength regions in which the developed silver absorbs light and the vehicle of the emulsion layer units and interlayer units (here used to mean all of the nonreflective components) are transmissive. One or both of the interlayer units reflect light during the reflection scans. Scanning radiation is absorbed by developed silver and reflected in other areas to produce two different reflection scanning channels of information. Optionally, one of the interlayer units can be an absorptive interlayer unit, and, in this instance, one of the reflection scans is conducted in a wavelength region in which the absorptive interlayer unit absorbs with reflection from the developed silver being relied upon for image discrimination. It is generally convenient to conduct each of the scans within an overall wavelength range of from 300 to 900 nm, which extends from the near ultraviolet through the visible portion of the spectrum and into the near infrared. Within this overall wavelength range the two reflection scans noted above can be in the same or different wavelength regions, depending on the particular approach to scanning selected. To minimize light absorption and/or reflection during the overall scan, this scan is preferably conducted in a different wavelength region than the two reflection scans. Although the overall 300 to 900 nm scanning bandwidth leaves ample latitude for broad band scanning wavelengths, it is generally preferred that each scan be conducted over bandwidths that can be easily established using commercially available filters. Laser scanning, of course, permits very narrow scanning bandwidths.

Beginning with the assumption that the support is transparent following photographic processing, the preferred scanning technique is to reflection scan the third emulsion layer unit of Structure I from above (assuming the orientation shown above) using the absorption or reflection of the second interlayer unit to restrict reflected image information to just that contained in the third emulsion layer unit. Similarly, the first emulsion layer unit of Structure I is also reflection scanned from beneath the support at a wavelength the first interlayer unit is capable of reflecting or absorbing to provide a record of the image in the first emulsion layer unit. The photographic element is then scanned through the support, the two interlayer units and all emulsion layer units.

At least one of the interlayer units is reflective within a wavelength region used for reflection scanning. In one preferred form of the invention the second interlayer unit absorbs within the wavelength region used to reflection scan the third emulsion layer unit, and the first interlayer unit is reflective within the wavelength region used to reflection scan the first emulsion layer unit. This arrangement offers the advantage that the second and third emulsion layer units can produce images of maximum sharpness. The advantage of the first interlayer unit being reflective is that a higher amplitude reflectance signal is available than when an absorptive interlayer unit is employed. Another advantage of this structure is that the absorption of the second interlayer unit can be used not only during reflection scanning from above, but it can also be used during imagewise exposure to protect the underlying first and second emulsion layer units from unwanted blue exposure when these layer units are intended to record green and red light and exhibit'significant levels of native blue sensitivity. Reflection of light by the first interlayer unit that the first emulsion layer unit is intended to record can be minimized by selecting the first interlayer unit to reflect light preferentially in another wavelength region and/or by forming the discrete phase responsible for reflection after imagewise exposure.

It is also possible to form the first interlayer unit of an absorbing material and to form the second interlayer unit of reflective material.

It is alternatively possible to construct Structure I with both the first and second interlayer units being reflective interlayer units. The advantage of this construction is that the amplitude of the reflected signals during reflection scanning from above and below are both increased as compared to employing an absorptive interlayer unit lacking light reflecting properties. When the second interlayer unit is a reflective interlayer unit, it can still be capable of absorbing light in the blue portion of the spectrum to protect the underlying emulsion layer units from unwanted blue exposure during imaging. For example, the continuous phase of the second interlayer unit can be identical to the blue absorbing interlayer unit in any conventional multicolor silver halide photographic element. It is also possible to employ a blue absorbing discrete phase, such as silver iodide, in the second interlayer unit.

Taking LS-1 (B/IL2/G/IL1/R/S) as an example, if it is assumed that the light absorption and reflection properties of the interlayer units remain substantially the same during imagewise exposure and scanning and it is further assumed that silver halides having significant native blue sensitivity are employed in each emulsion layer unit, the following transmission and absorption characteristics of the interlayer units are preferred: IL2 is a nonreflective interlayer unit that absorbs blue light and transmits green and red light. Whether IL2 transmits or absorbs in the near ultraviolet and near infrared is entirely a matter of choice, depending on the specific scanning wavelengths chosen. A yellow dye that does not decolorize during photographic processing is a simple choice for IL2. A yellow dye combined with a near UV or near IR absorber, where reflection scanning is conducted outside the visible spectrum is another possible choice. IL1 transmits red light during exposure and reflects light in one of the near UV, blue, green and near IR portions of the spectrum during reflection scanning. Exemplary preferred choices for constructing IL1 include high iodide silver halide grains, passivated silver bromoiodide grains, or any discrete phase and continuous phase combination that satisfies the preferred refractive index (n) difference of $>0.40$, with the discrete and continuous phases both exhibiting a refractive index (ik) in the red region of $<0.01$. IL2 also preferably absorbs light in the blue region of the spectrum, although the IL1 can alone be relied upon for blue light absorption.

In an alternative construction IL1 and IL2 can both be reflective interlayer units. IL2 is preferably chosen to reflect principally in the near UV and/or blue or near IR region of the spectrum. When IL2 is chosen to reflect in the blue region of the spectrum, the blue reflection is useful not only during scanning but also during exposure to limit unwanted blue exposure of underlying emulsion layer units and to boost the speed of the overlying blue recording layer unit. In an alternative construction a blue absorbing layer can be coated immediately beneath IL2. The construction of IL1 remains as described in the prior paragraph. In this form of the invention IL1 and IL2 can be identical in their construction.

Taking LS-3 (G/IL2/R/IL1/B/S) as another example, if it is assumed that the light absorption and reflection properties of the interlayer units remain substantially the same during imagewise exposure and scanning and it is further assumed that silver halides lacking significant native blue sensitivity are employed in each emulsion layer unit, the following transmission and absorption characteristics of the interlayer units are preferred: To satisfy exposure requirements IL1 cannot absorb in the blue and IL2 cannot absorb in the red or blue. To satisfy scanning requirements it is preferred that IL2 be a non-reflective interlayer unit that absorbs in the near UV, near IR or green portion of the spectrum. Thus, a magenta dye is preferably incorporated in IL2 with near UV absorbers or near IR absorbers being alternative choices. IL1 is preferably a reflective interlayer unit that reflects in any convenient region of the spectrum, but preferably exhibits minimal reflection in the blue region of the spectrum. Scanning can be simplified when IL2 absorbs and IL1 reflects in the green region of the spectrum. This allows the overall scan to be conducted in any region of the spectrum, except the green. When IL1 absorbs in one region of the spectrum and IL2 reflects in another region, all remaining regions are available for the overall scan. For example, if IL2 contains a magenta dye and IL1 preferentially reflects red light, the overall scan can be efficiently conducted in the near UV or blue portions of the spectrum.

In an alternative form LS-3 can contain two reflective interlayer units. In such an arrangement IL2 preferably exhibits peak reflection in the green region of the spectrum, since this has the effect of boosting the speed of the green recording emulsion layer unit. IL1 preferably exhibits maximum reflection in the green or red portions of the spectrum. Red reflection offers the advantage of boosting the speed of the overlying red recording layer unit. Green reflection simplifies scanning, since the same scanning wavelengths are used for both reflection scans.

In the discussion above three different scans have been referred to, two reflection scans and one transmission scan. It is appreciated that in terms of the actual mechanics of scanning the same light source can be used for simultaneously performing one of the reflection scans and the transmission scan. For example, assuming interlayer units IL1 and IL2 each reflect blue light and the support is transparent, a white light source can be used to scan Structure I. The reflection scan information for the first or third emulsion layer unit is obtained by passing the reflected light through a blue filter. The portion of the white light that passes through Structure I can be passed through a yellow filter to obtain the transmission scan information. After inverting Structure I the same white light source can be used in a separate addressing sequence for the remaining reflection scan, again using a blue filter. Instead of inverting Structure I it is generally more convenient to provide a separate reflection scanner on each side of Structure I. When one of IL1 and IL2 absorbs blue light, the scanning procedures are unchanged, but the sense of one of one reflection scan image is reversed.

When the spectral region of reflection or absorption of the interlayer units is varied, the absorptions of the filters are correspondingly varied. For example, with two green reflecting interlayer units the reflection scan filters are green and the transmission filter is magenta. With one yellow reflecting interlayer unit and one magenta reflecting interlayer unit a blue filter is used to obtain reflection information from the emulsion layer unit nearest the yellow reflecting interlayer unit, a green filter is used to obtain reflection information from the emulsion layer unit nearest the magenta reflecting filter, and a red filter is used to obtain the transmission scan information.

In an alternative scanning technique the two reflection scans of differing wavelength regions are conducted from the same side of the photographic element. That is, both the reflection scans can be performed by addressing the emulsion layer units of Structure I from above the support (assuming the orientation shown above) or by addressing the emulsion layer units through the support, assuming a transparent support after photographic processing. When the support is transparent, the overall scan is a transmission scan that can be conducted using a light source that is directed toward Structure I from either side. When the support is reflective (e.g., white) the overall scan is conducted from the same side of the support as the two reflection scans. An advantage of performing the overall scan on an element having a reflective support is that the scanning beam twice traverses the emulsion layer units and thereby provides a larger signal modulation.

In one preferred approach three reflective scans are performed, all by addressing Structure I from the same side. For this approach Structure I must have a reflective support or it must be placed against a reflective surface for scanning. The advantage of this approach is that the three scans can be conducted in any sequential or concurrent combination. For example, three separate light sources can be used to perform three separate scans concurrently. Alternatively, one light source can be used and filters can be used to supply each scan record selectively to the appropriate sensor. The advantages of this approach are that only one light source is required and the consolidation of all scans into one addressing operation greatly simplifies the task of spatial registration that forms an integral part of correlating pixel-by-pixel information from different scans. When all scanning is conducted from one side, the support can be either transparent or reflective. When the support is reflective, the light source or sources and all three sensors for the scan records are located above Structure I. In all forms of the invention, when the scans are conducted sequentially, it is possible to use the same sensor for successive scans.

Taking LS-1 (B/IL2/G/IL1/R/S) as an example for illustrating three reflection scans of differing wavelengths from the same side of the photographic element when it contains a reflective support, if it is assumed that the hue of the interlayer units remains substantially the same during imagewise exposure and scanning and it is further assumed that silver halides having significant native blue sensitivity are employed in each emulsion layer unit, the following transmission, reflection and absorption characteristics of the interlayer units are preferred: IL2 can take any form previously described for reflection scanning from opposite sides of the support, except that in this instance IL2 must be capable of transmitting light in two other regions of the spectrum, instead of just one. A yellow dye that does not decolorize during photographic processing is a simple choice for IL2. Since IL2 must transmit light during two other scans, it is preferred to limit the absorption of IL2 to the blue region of the spectrum. IL1 must transmit red light during exposure and must reflect light in one region of the spectrum other than the blue during scanning. In one preferred form IL1 reflects in the green region of the spectrum. Additionally IL1 can optionally supplement IL2 in protecting R from blue light exposure by absorbing in the blue. In this preferred form IL1 absorbs blue light and reflects green light. When IL1 transmits red and absorbs green light and IL2 (and optionally IL1) absorbs blue light, the overall scan can be conducted in the red portion of the spectrum or outside the visible spectrum in the near UV or near IR. The spectral adjacency of the near IR and red regions of the spectrum make these two most attractive for use separately or together for the overall scan.

Taking LS-3 (G/IL2/R/IL1/B/S) as another example of performing three reflection scans of a photographic element containing a reflective support, if it is assumed that the hue of the interlayer units remains substantially the same during imagewise exposure and scanning and it is further assumed that silver halides lacking significant native blue sensitivity are employed in each emulsion layer unit, the following transmission, reflection and absorption characteristics of the interlayer units are preferred: To satisfy exposure requirements IL2 must transmit red and blue light and to satisfy scanning requirements IL2 absorbs in at least one other region of the spectrum. Therefore, in a preferred form IL2 contains a magenta dye. A near UV or near IR absorber can be substituted for the magenta dye, but are not preferred. To satisfy exposure requirements IL1 must transmit blue light, and to satisfy scanning requirements IL1 reflects light in a wavelength region other than the blue and further reflects light in a wavelength region in which IL2 does not absorb light. Thus, when IL2 contains a magenta dye, IL1 preferably reflects red and/or near IR light. The overall scan is preferably performed in a spectral wavelength region in which IL1 and IL2 are transmissive. For example, when IL1 exhibits maximum reflection in the red region of the spectrum and IL2 contains a magenta dye, the overall scan is preferably performed in the blue and/or near UV portions of the spectrum.

In performing three reflection scans from above Structure I (as shown above) a first scan wavelength is absorbed by IL2, and the light reflected from the third emulsion layer unit provides a record of the imagewise exposure of the third emulsion layer unit only. A second scan wavelength is reflected by IL1, and the reflected light modulated by developed silver in the second and third emulsion layer units is recorded. This provides a combined record of the image patterns in the second and third emulsion layers. By comparing the first and second scans the image within the second emulsion layer unit can be obtained. The overall scan provides a record of the attenuation of light passing twice through all of the emulsion layer units. The information obtained by the overall scan is then a combined image record of all the emulsion layer units. By comparing the combined record with the records from the previous scans an image corresponding to that of the first emulsion layer unit alone can be obtained.

It is possible to perform the three reflection scans described above using a photographic element with a transparent support. The transparent support is placed in optical contact with a reflective backing during at least the third scan. With a transparent support it is also possible to perform two reflection scans from above the support as described while performing the overall scan as a transmission scan. Still another option is to perform two reflection scans through a transparent support or three reflection scans through a transparent support when the third emulsion layer unit is mounted in optical contact with a reflective backing.

From the foregoing detailed description of specific preferred interlayer unit choices for LS-1 and LS-3, the photographically most attractive layer sequences for emulsions having and lacking, respectively, significant native blue silver halide sensitivity, the specific interlayer unit selections for the remaining possible layer sequences LS-2, LS-4, LS-5 and LS-6 are apparent by analogy.

Conventional scanning techniques satisfying the requirements described above can be employed, including point-by-point, line-by-line and area scanning, and require no detailed description. A simple technique for scanning is to scan the photographically processed element point-by-point along a series of laterally offset parallel scan paths. The intensity of light reflected from or passing through the photographic element at a scanning point is noted by a sensor which converts radiation received into an electrical signal. The electrical signal is passed through an analogue to digital converter and sent to memory in a digital computer together with locant information required for pixel location within the image. Signal comparisons and mathematical operations to resolve scan records that represent combinations of two or three different images can be undertaken by routine procedures once the information obtained by scanning has been placed in the computer.

Once the image records corresponding to the latent images have been obtained, the original image or selected variations of the original image can be reproduced at will. The simplest approach is to use lasers to expose pixel-by-pixel a conventional color paper. Simpson et al U.S. Pat. No. 4,619,892 discloses differentially infrared sensitized color print materials particularly adapted for exposure with near infrared lasers. Instead of producing a viewable hard copy of the original image the image information can instead be fed to a video display terminal for viewing or fed to a storage medium (e.g., an optical disk) for archival storage and later viewing.

In the description of absorption, reflection and transmission characteristics it must be borne in mind that these are relative terms. Only a few materials absorb or reflect at invariantly high or low levels throughout the entire 300 to 900 nm spectral region of general interest. Therefore, absorption, reflection and transmission must be related to the specific spectral region of interest for a particular operation, such as exposure or scanning. Although the invention relies upon the reflectance of the interlayer unit discrete phase and continuous phase interface and, where a non-reflective interlayer unit is employed, the reflectance of silver to provide the scanning record, only a fraction of the light received by either is reflected in most forms of the invention. For example, silver reflects only about 5 percent of the light it receives. This is a low reflectance, but one that can be detected against a nonreflective interlayer unit background. On the other hand, when an interlayer unit contains discrete and continuous phases that have refractive indices (n) that differ by more than 0.40, it provides a much more reflective background, allowing the 95 percent light absorption by developed silver to provide a detectable modulation of reflectance. By silver halide grain selection in the manner previously described individual grain reflectances can range up to 30 percent or higher in a wavelength region in which reflection is sought and down to 10 percent or lower in another wavelength region in which minimal reflection is sought. Discrete phases that are formed after imagewise exposure can exhibit extremely high reflectances; however, to accommodate overall scanning it is preferred to limit individual interlayer unit reflectances. When the interlayer unit discrete phase is present before imagewise exposure and its reflective qualities are more or less uniform, a balance must be struck between the light transmission required by imagewise exposure and the reflection that is required for scanning.

Overall, it is contemplated that each emulsion layer unit will receive at least 25 percent, preferably at least 50 percent and optimally at least 75 percent of the light it is intended to record. It is contemplated that in overall scanning typically from 25 to 75 percent of the reflection or transmission scanning beam will reach the sensor in areas containing no developed silver. In reflection scanning of an emulsion layer unit overlying an absorptive interlayer unit only about 5 percent of the reflection scanning beam is returned to the sensor in areas exhibiting maximum silver development. In reflection scanning of an emulsion layer unit utilizing a reflective interlayer unit it is contemplated that at least 10 percent and often 75 percent of the reflection beam will reach the sensor in areas containing no developed silver in the emulsion layer unit or units being scanned.

Assuming that Structure I employs a transparent support, a nonreflective absorptive interlayer unit IL2 and a reflective interlayer unit IL1 that reflects more or less uniformly in all spectral regions of interest (e.g., the discrete phase is formed of white particles) the following balance of reflection, absorption and transmission characteristics is contemplated: The IL2 can be constructed to absorb selectively in the wavelength region the third emulsion layer unit is intended to record. Therefore the second and third emulsion layer units can receive substantially all of the light they are intended to record. IL1 reflects at least 10 percent and preferably no more than 75 percent of the light the first emulsion layer unit is intended to record. To obtain a high level of image sharpness in the first emulsion layer unit it is preferred that IL1 reflect from 10 to 25 percent of the light it receives. The indicated reflection ranges of IL1 permit reflection scanning through the photographic support and overall transmission scanning. This embodiment is hereinafter referred to as 3ELU/AbIL2-/2ELU/RIL1/1ELU/TS.

The description above is equally applicable whether RIL1 is a unitary or composite reflective interlayer unit. To provide a specific illustration of a composite reflective interlayer unit the embodiment 3ELU/AbIL2/2ELU/AbSL-RSL/1ELU/TS is described, the sole difference from the preceding paragraph being expansion of the notation RIL1 to AbSL-RSL, where AbSL represents an absorptive sub-layer and RSL represents a reflective sub-layer. RSL has the same properties as RIL1 described above. AbSL is selected to specularly transmit light that 1ELU is intended to record and to absorb light that RSL is intended to reflect.

If a reflective support RS is substituted for the transparent support TS (or scanning is undertaken with the transparent support placed in optical contact with a reflective material), the embodiment becomes 3ELU/AbIL2/2ELU/RIL1/1ELU/RS. Now both reflection scans and the overall scan must be undertaken from above the reflective support RS. The only significant performance difference this entails is that the overall scan must now twice penetrate the reflective interlayer unit RIL1. The maximum reflectance of RIL1 is therefore reduced to less than 50 percent. When the reflectance of RIL1 is just less than 50 percent, nearly 25 percent of the overall scanning beam can be returned to the sensor in areas lacking developed silver. It is also necessary that the reflectances from RIL1 and RS be spectrally non-coextensive—i.e., one of RIL1 and RS must reflect to a significantly greater extent in at least one spectral region than the other.

The description above is equally applicable whether RIL1 is a unitary or composite reflective interlayer unit. To provide a specific illustration of a composite reflective interlayer unit the embodiment 3ELU/AbIL2/2ELU/RSL-AbSL/1ELU/RS is described, the sole difference of the preceding paragraph being expansion of the notation RIL1 to RSL-AbSL, where AbSL represents an absorptive sub-layer and RSL represents a reflective sub-layer. RSL has the same properties as RIL1 described above. AbSL is selected to specularly transmit light that 1ELU is intended to record and to absorb light that RSL is intended to reflect. Note that the sole difference between the embodiment above having a transparent support (TS) and the embodiment having a reflective support (RS) is the reversal of the absorptive (AbSL) and reflective (RSL) sub-layers, reflecting the change in direction from which the reflection scanning of 1EU OCCURS.

If 3ELU/AbIL2/2ELU/RIL1/1ELU/TS is modified to the structural form 3ELU/RIL2/2ELU/RIL1-/1ELU/TS by substituting a second reflective interlayer unit for the absorptive interlayer unit, the following balance of reflection, absorption and transmission characteristics is contemplated: Light that the first emulsion layer unit 1ELU is intended to record must pass through both RIL2 and RIL1. For 1ELU to receive at least 25 percent of the light it is intended to record RIL1 and RIL2 must each reflect less than 50 percent of this light, assuming both of the interlayer units are equally reflective. A preferred balance is for each of RIL1 and RIL2 to reflect from 10 to 25 of the light they receive, which is entirely adequate for reflection scanning while allowing up to 81 percent of the light 1ELU is intended to record to be received by this emulsion layer unit. With 1ELU exposure considerations setting the maximum reflectance from RIL2, it is apparent that 2ELU in all instances receives a high percentage of the light it is intended to record, while 3ELU receives all of the light it is intended to record. When RIL1 and RIL2 are each capable of reflecting up to 50 percent the light they receive, it is apparent that at least 25 percent of the light used for overall transmission scanning is received by the scanning sensor in areas containing no developed silver.

When 3ELU/RIL2/2ELU/RIL1/1ELU/TS is expanded to indicate composite reflective interlayer units, this embodiment becomes 3ELU/RSL2-AbSL2/2ELU/AbSL1-RSL1/1ELU/TS.

The construction and performance of the two composite reflective interlayer units is apparent from the discussion of the two embodiments containing a single composite reflective interlayer unit. In addition it should be noted that when 3ELU is a blue recording emulsion layer unit and 2ELU and 1ELU are minus blue recording emulsion layer units that possess unwanted blue sensitivity it is advantageous to perform the reflection scan of 3ELU in the blue region of the spectrum with AbSL2 being blue absorbing (i.e., yellow). This allows AbSL2 to perform an additional function of protecting 2ELU and 1ELU from unwanted blue exposures. AbSL2 can also protect 3ELU from unwanted halation exposure by intercepting exposing light reflected from the support. In addition is should be noted that when AbSL1 absorbs and RSL1 reflects light in the wavelength region 2ELU is intended to record, AbSL1 and AbSL2 can together reduce halation exposure to the point that the commonly employed separate antihalation layer (not indicated in the notation scheme above), typically coated between the emulsion layer units and the support or on the back side of the support and decolorized during photographic processing, can be eliminated with little or no degradation in performance.

When 3ELU/RIL2/2ELU/RIL1/1ELU/TS is modified by substituting a reflective support RS for TS, analogous reductions in maximum reflectances in the RIL1 and RIL2 interlayer units are undertaken similarly as described above in modifying 3ELU/AbIL2-/2ELU/RIL1/1ELU/TS to create 3ELU/AbIL2-/2ELU/RIL1/1ELU/RS. When 3ELU/RIL2-/2ELU/RIL1/1ELU/TS contains composite reflective interlayer units, the embodiment becomes 3ELU/RSL2-AbSL2/2ELU/RSL1-AbSL1/1ELU/RS.

The advantages of the is embodiment are the same as those of the corresponding embodiment having a transparent support (TS) above and require no further description.

The reflectances of exposing light the emulsion layer units are intended to record and the limits on maximum reflectances for scanning are all based on worst case assumptions. If the discrete phase is formed in the reflective interlayer unit or interlayer units following imagewise exposure, the interlayer units can transmit imagewise exposing radiation without any significant reflection and the maximum reflection of the interlayer units can approach a theoretical maximum of 100 percent. If the reflectance of an interlayer unit is higher in a scanning wavelength region than in the wavelength region or regions that the underlying emulsion layer unit or units are intended to record, a more favorable balance between reflection during imagewise exposure and reflection during scanning can be realized.

One of the challenges encountered in producing images from information extracted by scanning is that the number of pixels of information available for viewing is only a fraction of that available from a comparable classical photographic print. It is therefore even more important in scan imaging to maximize the quality of the image information available from each pixel. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily. Although the invention is described in terms of point-by-point scanning, it is appreciated that conventional approaches to improving image quality are contemplated. Illustrative systems of scan signal manipulation, including techniques for maximizing the quality of image records, are disclosed by Bayer U.S. Pat. Nos. 4,553,165, Urabe et al 4,591,923, Sasaki et al 4,631,578, Alkofer 4,654,722, Yamada et al 4,670,793, Klees 4,694,342, Powell 4,805,031, Mayne et al 4,829,370, Abdulwahab 4,839,721, Matsunawa et al 4,841,361 and 4,937,662, Mizukoshi et al 4,891,713, Petilli 4,912,569, Sullivan et al 4,920,501, Kimoto et al 4,929,979, Klees 4,962,542, Hirosawa et al 4,972,256, Kaplan 4,977,521, Sakai 4,979,027, Ng 5,003,494, Katayama et al 5,008,950, Kimura et al 5,065,255, Osamu et al 5,051,842, Lee et al 5,012,333, Sullivan et al 5,070,413, Bowers et al 5,107,346, Telle 5,105,266, MacDonald et al 5,105,469, and Kwon et al 5,081,692, the disclosures of which are here incorporated by reference.

The multicolor photographic elements and their photographic processing, apart from the specific required features described above, can take any convenient conventional form. A summary of conventional photographic element features as well as their exposure and processing is contained in *Research Disclosure*, Vol. 308, December 1989, Item 308119, and a summary of tabular grain emulsion and photographic element features and their processing is contained in *Research Disclosure*, Vol. 225, December 1983, Item 22534, the disclosures of which are here incorporated by reference.

Although the invention has been described in terms of preferred embodiments in which all three emulsion layer units form only silver images, it is appreciated that the invention is also applicable to analogous photographic elements in which two emulsion layer units separated by a reflective interlayer as described above form only a silver image and a third emulsion layer unit forms both a silver and a dye image. This alternative construction is demonstrated in the Examples below. When one emulsion layer unit forms a dye image the sole required interlayer is the reflective interlayer between the two emulsion layer units that form only a silver image.

EXAMPLES

The invention can be better appreciated by reference to the following specific examples. In each of the examples coating densities, set out in brackets ([]) are reported in terms of grams per square meter ($g/m^2$), except as specifically noted. Silver halide coverages are reported in terms of silver. All emulsions were sulfur and gold sensitized and spectrally sensitized to the spectral region indicated by the layer title. Filter dye and oxidized developer scavenger were dispersed in gelatin solution in the presence of approximately equal amounts of supplemental solvents, such as tricresyl phosphate, dibutyl phthalate, or diethyl lauramide.

Example 1

A color recording film was prepared by coating the following layers in order on cellulose triacetate film base. The silver halide emulsions used were of the tabular grain type except where otherwise stated, and were silver bromoiodide having between 1 and 6 mol % iodide.

Layer 1; Antihalation Underlayer

Gelatin, [2.5]
Antihalation dye C.I. Solvent Blue 35, [0.06]

Layer 2: Red-sensitized Layer

Gelatin, [2.5]

Fast red-sensitized emulsion [0.45] (ECD 3.0 μm, thickness, t, 0.12 μm)
Mid-speed red-sensitized emulsion, [0.20] (ECD 1.5 μm, t 0.11 μm)
Slow red-sensitized emulsion, [0.45] (ECD 0.72 μm, t 0.11 μm)
Scavenging agent A, [0.3]

Layer 3: Reflective interlayer Unit

Gelatin [2.5]
Titanium dioxide, [1.5] (Tioxide RXL TM supplied by BTP Tioxide Limited, and ball milled as a 20 weight percent suspension in water in the presence of 0.3 weight percent sodium triisopropyl naphthalene sulfonate)

Layer 4: Green-Sensitized Layer

Gelatin, [2.0]
Fast green-sensitized emulsion, [1.0], (ECD 2.3 μm, t 0.12 μm)
Mid green-sensitized emulsion, [0.4] (ECD 1.5 μm, t 0.11 μm)
Slow green-sensitized emulsion, [0.5] (ECD 0.7 μm, t 0.11 μm)
Scavenging agent A, [0.30]

Layer 5: Absorptive Interlayer Unit

Gelatin, [1.0]
Yellow filter dye, [0.25]

Layer 6; Blue-Sensitive Layer

Gelatin, [1.5]
Fast blue-sensitive emulsion, [0.13 ] (non-tabular, ECD 1.0 μm)
Mid blue-sensitive emulsion, [0.07] (ECD 1.39 μm, t 0.11 μm)
Slow blue-sensitive emulsion, [0.05] (ECD 0.72 μm, t 0.84μm)
Slow blue-sensitive emulsion, [0.08] (ECD 0.32 μm, t 0.072 μm)
Keto-methylene yellow dye- forming coupler, [0.9]
Hardener bis (vinylsulfonyl)methane, [0.16]

Layer 7: Supercoat

Gelatin, [1.5]

Also present in every emulsion-containing layer were 4-hydroxy-6-methyl-1,3,3A,7-tetraazindene, sodium salt, at 1.25g per mole of silver, and 2-octadecyl-5-sulfohydroquinone, sodium salt, at 2.4g per mole of silver. Surfactants used to aid the coating operation are not listed in these examples.

Scavenging agent A was of structure:

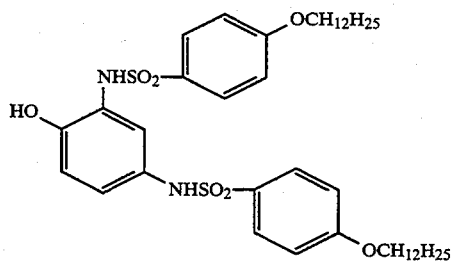

A sample of the film was sensitometrically exposed to white light through a graduated density step wedge (density increment 0.2 density units per step), and others were exposed through the graduated density step wedge to light which had been filtered through Wratten TM 29, 74 and 98 filters, to give red, green and blue exposures, respectively. The film samples were then developed for two and a half minutes in Kodak C41 TM color developer solution at 40° C., given 30 seconds in an acetic acid stop bath, then fixed for two minutes in Kodak A3000 TM 0 fixer solution diluted with water (one part fixer in three parts water) and with 20 g/l sodium sulfite added to the solution.

Status M red and blue transmission densities (RTR and BTR, respectively) and status M red reflection density measured through the support (RRF) were determined for each level of exposure for photographically processed film samples given red, green, blue, and neutral exposures. For each type of measurement (BTR, RTR, and RRF) a minimum density (BTRmin, RTRmin, and RRFmin, respectively) was measured for a photographically processed film sample that had not been exposed to light. New film responses (BTR', RTR', and RRF') were determined for all exposures by subtracting the minimum density from the corresponding measured responses $$BTR' = BTR - BTRmin$$

$$RTR' = RTR - RTRmin$$

$$RRF = RRF - RRFmin$$

The BTR', RTR', and RRF' responses for the neutral, blue, green, and red exposures are tabulated as a function of relative log exposure in Tables I through IV,

TABLE I

| Relative Log Exposure | RRF' | RTR' | BTR' |
|---|---|---|---|
| 0.0 | 0.00 | 0.00 | 0.00 |
| 0.2 | 0.00 | 0.01 | 0.01 |
| 0.4 | 0.01 | 0.02 | 0.04 |
| 0.6 | 0.02 | 0.05 | 0.09 |
| 0.8 | 0.05 | 0.10 | 0.17 |
| 1.0 | 0.08 | 0.18 | 0.29 |
| 1.2 | 0.12 | 0.27 | 0.43 |
| 1.4 | 0.18 | 0.38 | 0.59 |
| 1.6 | 0.25 | 0.49 | 0.75 |
| 1.8 | 0.32 | 0.62 | 0.93 |
| 2.0 | 0.39 | 0.75 | 1.13 |
| 2.2 | 0.43 | 0.87 | 1.32 |
| 2.4 | 0.49 | 0.99 | 1.53 |
| 2.6 | 0.52 | 1.10 | 1.72 |
| 2.8 | 0.54 | 1.18 | 1.88 |
| 3.0 | 0.57 | 1.27 | 2.06 |
| 3.2 | 0.59 | 1.34 | 2.22 |
| 3.4 | 0.60 | 1.40 | 2.35 |
| 3.6 | 0.61 | 1.44 | 2.45 |
| 3.8 | 0.62 | 1.49 | 2.57 |
| 4.0 | 0.63 | 1.56 | 2.70 |

TABLE II

| Relative Log Exposure | RRF' | RTR' | BTR' |
|---|---|---|---|
| 0.0 | 0.00 | 0.00 | 0.00 |
| 0.2 | 0.00 | 0.00 | 0.00 |
| 0.4 | 0.00 | 0.00 | 0.01 |
| 0.6 | 0.02 | 0.00 | 0.03 |
| 0.8 | 0.02 | 0.01 | 0.07 |
| 1.0 | 0.02 | 0.02 | 0.13 |
| 1.2 | 0.02 | 0.03 | 0.20 |
| 1.4 | 0.02 | 0.05 | 0.30 |
| 1.6 | 0.03 | 0.07 | 0.39 |
| 1.8 | 0.04 | 0.09 | 0.49 |
| 2.0 | 0.05 | 0.13 | 0.59 |

TABLE II-continued

| Relative Log Exposure | RRF' | RTR' | BTR' |
|---|---|---|---|
| 2.2 | 0.06 | 0.19 | 0.71 |
| 2.4 | 0.06 | 0.26 | 0.85 |
| 2.6 | 0.06 | 0.35 | 1.00 |
| 2.8 | 0.08 | 0.44 | 1.17 |
| 3.0 | 0.10 | 0.54 | 1.34 |
| 3.2 | 0.14 | 0.66 | 1.53 |
| 3.4 | 0.20 | 0.77 | 1.70 |
| 3.6 | 0.26 | 0.89 | 1.87 |
| 3.8 | 0.32 | 0.99 | 2.03 |
| 4.0 | 0.37 | 1.09 | 2.17 |

TABLE III

| Relative Log Exposure | RRF' | RTR' | BTR' |
|---|---|---|---|
| 0.0 | 0.00 | 0.00 | 0.00 |
| 0.2 | 0.00 | 0.01 | 0.01 |
| 0.4 | 0.01 | 0.03 | 0.03 |
| 0.6 | 0.02 | 0.08 | 0.08 |
| 0.8 | 0.03 | 0.14 | 0.15 |
| 1.0 | 0.04 | 0.21 | 0.21 |
| 1.2 | 0.04 | 0.29 | 0.29 |
| 1.4 | 0.04 | 0.37 | 0.37 |
| 1.6 | 0.04 | 0.46 | 0.47 |
| 1.8 | 0.04 | 0.54 | 0.56 |
| 2.0 | 0.04 | 0.62 | 0.65 |
| 2.2 | 0.05 | 0.70 | 0.75 |
| 2.4 | 0.10 | 0.77 | 0.85 |
| 2.6 | 0.14 | 0.86 | 0.95 |
| 2.8 | 0.21 | 0.93 | 1.04 |
| 3.0 | 0.29 | 1.01 | 1.14 |
| 3.2 | 0.34 | 1.07 | 1.22 |
| 3.4 | 0.41 | 1.15 | 1.32 |
| 3.6 | 0.46 | 1.20 | 1.38 |
| 3.8 | 0.51 | 1.24 | 1.44 |
| 4.0 | 0.54 | 1.31 | 1.54 |

TABLE IV

| Relative Log Exposure | RRF' | RTR' | BTR' |
|---|---|---|---|
| 0.0 | 0.00 | 0.00 | 0.00 |
| 0.2 | 0.03 | 0.01 | 0.01 |
| 0.4 | 0.06 | 0.04 | 0.05 |
| 0.6 | 0.11 | 0.07 | 0.08 |
| 0.8 | 0.17 | 0.11 | 0.12 |
| 1.0 | 0.25 | 0.16 | 0.17 |
| 1.2 | 0.32 | 0.22 | 0.22 |
| 1.4 | 0.40 | 0.28 | 0.28 |
| 1.6 | 0.45 | 0.32 | 0.33 |
| 1.8 | 0.50 | 0.38 | 0.39 |
| 2.0 | 0.54 | 0.42 | 0.43 |
| 2.2 | 0.56 | 0.44 | 0.45 |
| 2.4 | 0.59 | 0.48 | 0.49 |
| 2.6 | 0.60 | 0.49 | 0.50 |
| 2.8 | 0.61 | 0.51 | 0.52 |
| 3.0 | 0.62 | 0.53 | 0.54 |
| 3.2 | 0.63 | 0.55 | 0.57 |
| 3.4 | 0.63 | 0.55 | 0.58 |
| 3.6 | 0.63 | 0.56 | 0.60 |
| 3.8 | 0.64 | 0.57 | 0.60 |
| 4.0 | 0.65 | 0.59 | 0.63 |

respectively. Inspection of Tables II through IV indicates that the measured responses do not provide a direct measure of the individual recording layer unit images with the exception of RRF' as a measure of the red recording layer unit image. The measured BTR' and RTR' responses are affected by imagewise development in all three recording layer units due to the spectral neutrality of developed silver and the additivity of transmission densities. Mathematical manipulation of the measured responses was used to determine the individual images in the red, green, and blue recording layer units (R, G, and B, respectively) in terms of their corresponding transmission densities.

A plot of RTR' versus RRF' for the red separation exposure was made. Pinney and Vogelsong, Photographic Science and Engineering, 15, 487 (1971) used a fourth order polynomial to define an empirical relationship between reflection and transmission density. A best fit line satisfying the relationship $RTR'=a1\times RRF'+a2\times RRF'^2+a3\times RRF'^3+a4\times RRF'^4$ was determined using standard methods of non-linear regression. The following values were found for the "a" series of constants:

a1=0.503
a2=1.696
a3=−5.285
a4=5.664

The independent response of the red recording layer was determined by the following relationship $$R=a1\times RRF'+a2\times RRF'^2+a3\times RRF'^3+a4\times RRF'^4$$

A plot of RTR' versus (BTR'-RTR') was made for the blue separation exposure over the range of exposures where development was occurring predominantly in the blue recording layer only. A best fit line satisfying the relationship $$RTR'=b\times(BTR'-RTR')$$

was determined using standard methods of linear regression. The value of b was found to be 0.195. The independent response of the blue recording layer was determined using the following relationship $$B=b\times(BTR'-RTR')$$

The independent response of the green recording layer unit was determined using the following relationship $$G=RTR'-B-R$$

taking advantage of the spectral neutrality of the developed silver image in the three recording layer units and the additivity of transmission densities.

The independent recording layer responses determined for the neutral, blue, green, and red exposures determined using the relationships previously described are listed in Tables V through VIII, respectively.

TABLE V

| Relative Log Exposure | R | G | B |
|---|---|---|---|
| 0.0 | 0.00 | 0.00 | 0.00 |
| 0.2 | 0.00 | 0.00 | 0.00 |
| 0.4 | 0.01 | 0.01 | 0.00 |
| 0.6 | 0.01 | 0.03 | 0.01 |
| 0.8 | 0.03 | 0.06 | 0.01 |
| 1.0 | 0.05 | 0.10 | 0.02 |
| 1.2 | 0.08 | 0.16 | 0.03 |
| 1.4 | 0.12 | 0.21 | 0.04 |
| 1.6 | 0.17 | 0.27 | 0.05 |
| 1.8 | 0.22 | 0.34 | 0.06 |
| 2.0 | 0.27 | 0.40 | 0.07 |
| 2.2 | 0.30 | 0.48 | 0.09 |
| 2.4 | 0.36 | 0.53 | 0.10 |
| 2.6 | 0.39 | 0.59 | 0.12 |
| 2.8 | 0.42 | 0.63 | 0.14 |
| 3.0 | 0.46 | 0.66 | 0.15 |
| 3.2 | 0.49 | 0.68 | 0.17 |
| 3.4 | 0.50 | 0.70 | 0.19 |
| 3.6 | 0.52 | 0.72 | 0.20 |

TABLE V-continued

| Relative Log Exposure | R | G | B |
|---|---|---|---|
| 3.8 | 0.54 | 0.74 | 0.21 |
| 4.0 | 0.56 | 0.78 | 0.22 |

TABLE VI

| Relative Log Exposure | R | G | B |
|---|---|---|---|
| 0.0 | 0.00 | 0.00 | 0.00 |
| 0.2 | 0.00 | 0.00 | 0.00 |
| 0.4 | 0.00 | 0.00 | 0.00 |
| 0.6 | 0.01 | −0.01 | 0.01 |
| 0.8 | 0.01 | −0.01 | 0.01 |
| 1.0 | 0.01 | −0.02 | 0.02 |
| 1.2 | 0.01 | −0.02 | 0.03 |
| 1.4 | 0.01 | −0.01 | 0.05 |
| 1.6 | 0.02 | −0.01 | 0.06 |
| 1.8 | 0.02 | −0.01 | 0.08 |
| 2.0 | 0.03 | 0.01 | 0.09 |
| 2.2 | 0.04 | 0.05 | 0.10 |
| 2.4 | 0.04 | 0.11 | 0.11 |
| 2.6 | 0.04 | 0.18 | 0.13 |
| 2.8 | 0.05 | 0.25 | 0.14 |
| 3.0 | 0.06 | 0.32 | 0.16 |
| 3.2 | 0.09 | 0.40 | 0.17 |
| 3.4 | 0.14 | 0.46 | 0.18 |
| 3.6 | 0.18 | 0.52 | 0.19 |
| 3.8 | 0.22 | 0.57 | 0.20 |
| 4.0 | 0.26 | 0.63 | 0.21 |

TABLE VII

| Relative Log Exposure | R | G | B |
|---|---|---|---|
| 0.0 | 0.00 | 0.00 | 0.00 |
| 0.2 | 0.00 | 0.01 | 0.00 |
| 0.4 | 0.01 | 0.03 | 0.00 |
| 0.6 | 0.01 | 0.07 | 0.00 |
| 0.8 | 0.02 | 0.13 | 0.00 |
| 1.0 | 0.02 | 0.19 | 0.00 |
| 1.2 | 0.02 | 0.27 | 0.00 |
| 1.4 | 0.02 | 0.35 | 0.00 |
| 1.6 | 0.02 | 0.43 | 0.00 |
| 1.8 | 0.02 | 0.51 | 0.00 |
| 2.0 | 0.02 | 0.59 | 0.01 |
| 2.2 | 0.03 | 0.66 | 0.01 |
| 2.4 | 0.06 | 0.69 | 0.01 |
| 2.6 | 0.09 | 0.75 | 0.02 |
| 2.8 | 0.14 | 0.76 | 0.02 |
| 3.0 | 0.20 | 0.78 | 0.03 |
| 3.2 | 0.24 | 0.81 | 0.03 |
| 3.4 | 0.29 | 0.83 | 0.03 |
| 3.6 | 0.33 | 0.83 | 0.04 |
| 3.8 | 0.38 | 0.82 | 0.04 |
| 4.0 | 0.42 | 0.85 | 0.05 |

TABLE VIII

| Relative Log Exposure | R | G | B |
|---|---|---|---|
| 0.0 | 0.00 | 0.00 | 0.00 |
| 0.2 | 0.02 | 0.00 | 0.00 |
| 0.4 | 0.04 | 0.00 | 0.00 |
| 0.6 | 0.07 | 0.00 | 0.00 |
| 0.8 | 0.11 | 0.00 | 0.00 |
| 1.0 | 0.17 | −0.01 | 0.00 |
| 1.2 | 0.22 | 0.00 | 0.00 |
| 1.4 | 0.28 | −0.01 | 0.00 |
| 1.6 | 0.32 | 0.00 | 0.00 |
| 1.8 | 0.37 | 0.01 | 0.00 |
| 2.0 | 0.42 | 0.00 | 0.00 |
| 2.2 | 0.44 | 0.00 | 0.00 |
| 2.4 | 0.49 | −0.01 | 0.00 |
| 2.6 | 0.50 | −0.01 | 0.00 |
| 2.8 | 0.52 | −0.02 | 0.00 |
| 3.0 | 0.54 | −0.02 | 0.00 |

TABLE VIII-continued

| Relative Log Exposure | R | G | B |
|---|---|---|---|
| 3.2 | 0.56 | −0.02 | 0.00 |
| 3.4 | 0.56 | −0.02 | 0.01 |
| 3.6 | 0.56 | 0.00 | 0.01 |
| 3.8 | 0.58 | −0.02 | 0.01 |
| 4.0 | 0.60 | −0.02 | 0.01 |

Exposing a new piece of film in a conventional exposure device followed by photographic processing, scanning, and data processing as previously described yields independent responses for the red, green, and blue recording layer units at each pixel in the photographic element. A plot of R, B, and G versus input exposure provides the necessary relationships to convert the independent recording layer responses determined to corresponding input exposures. Using the exposure values determined for each pixel of the film as input signals to a digital printing device produces a photographic reproduction of the original scene.

The invention has been described in detail with particular reference to preferred embodiments thereof, but it will be understood that variations and modifications can be effected within the spirit and scope of the invention.

What is claimed is:

1. A silver halide photographic element capable of being scanned for image information following imagewise exposure and photographic development and fixing comprised of a support and, coated on the support, a sequence of superimposed blue, green and red recording silver halide emulsion layer units at least two of which produce images of the same hue upon processing, one of the emulsion layer units forming a first emulsion layer unit in the sequence coated nearest the support, another of the emulsion layer units forming a last emulsion layer unit in the sequence coated farthest from the support, and one other of the emulsion layer units forming an intermediate emulsion layer unit located between the first and last emulsion layer units, and an interlayer unit coated between two of the emulsion layer units that produce images of the same hue so that one of the two emulsion layer units that produce images of the same hue overlies the interlayer unit and one or both of the remaining emulsion layer units are located nearer to the support than the interlayer unit, the interlayer unit being capable of transmitting to said one or both emulsion layer units nearer to the support electromagnetic radiation said one or both emulsion layer units are provided to record, the interlayer unit including means for reflecting in a scanning wavelength region following photographic development and fixing.

2. A silver halide photographic element capable of being scanned for image information following imagewise exposure and photographic development and fixing comprised of a support and, coated on the support, a sequence of superimposed blue, green and red recording silver halide emulsion layer units that produce images of the same hue upon processing, one of the emulsion layer units forming a first emulsion layer unit in the sequence coated nearest the support, another of the emulsion layer units forming a last emulsion layer unit in the sequence coated farthest from the support, and one other of the emulsion layer units forming an intermediate emulsion layer unit located between the first and last emulsion layer units, and a first interlayer unit coated between the first emulsion layer unit and the intermediate emulsion layer unit capable of transmitting to the first emulsion layer unit electromagnetic radiation this emulsion layer unit is provided to record and a second interlayer unit coated between the intermediate emulsion layer unit and the last emulsion layer unit capable of transmitting to the first and intermediate emulsion layer units electromagnetic radiation these emulsion layer units are provided to record, one of the interlayer units including means for reflecting in a scanning wavelength region following photographic development and fixing and the remaining interlayer unit including means for reflecting or absorbing in a scanning wavelength region following photographic development and fixing.

3. A silver halide photographic element according to claim 2 wherein at least one said interlayer unit containing means for reflecting in a scanning wavelength region is comprised of hollow beads.

4. A silver halide photographic element according to claim 2 wherein at least one interlayer unit is comprised of a discrete phase dispersed in a continuous phase, the discrete phase exhibiting in the scanning wavelength region an index of refraction that exhibits an absorption representing component of less than $10^{-2}$ and a diffraction representing component that differs by greater than 0.2 from the index of refraction of the continuous phase.

5. A silver halide photographic element according to claim 4 wherein each of the interlayer units is after photographic development and fixing a reflective interlayer unit comprised of a discrete phase dispersed in a continuous phase, the discrete phase exhibiting in the scanning wavelength region an index of refraction that differs by at least 0.4 from the index of refraction of the continuous phase.

6. A silver halide photographic element according to claim 2 wherein at least one of the interlayer units contains reflective pigment particles or a precursor capable of providing reflective pigment particles after imagewise exposure has occurred.

7. A silver halide photographic element according to claim 6 wherein at least one of the interlayer units contains zinc oxide, titanium oxide or barium sulfate particles.

8. A silver halide photographic element according to claim 2 wherein at least one of the reflective interlayer units contains silver halide grains that are not dissolved during fixing.

9. A silver halide photographic element according to claim 8 wherein the interlayer unit silver halide grains that are not dissolved during fixing are nontabular grains having a mean equivalent circular diameter in the range of from 0.1 to 0.8 micrometer.

10. A silver halide photographic element according to claim 8 wherein the interlayer unit silver halide grains that are not dissolved during fixing have at least 90 percent of their projected area accounted for by tabular grains having a mean equivalent circular diameter greater than 0.4 micrometer, a mean tabular grain thickness of in the range of from 0.07 to 0.2 micrometer, and exhibit a coefficient of variation based on tabular grain thickness of less than 15 percent.

11. A silver halide photographic element according to claim 8 wherein at least one of the interlayer units contains silver halide grains containing more than 90 mole percent silver iodide, based on total silver.

12. A silver halide photographic element according to claim 8 wherein at least one of the interlayer units contains surface passivated silver halide grains.

13. A silver halide photographic element according to claim 2 wherein after development and fixing the first interlayer unit is a reflective interlayer unit in a scanning wavelength region and the second interlayer unit is an absorbing interlayer unit in a scanning wavelength region.

14. A silver halide photographic element according to claim 13 wherein the emulsion layer units are comprised of silver bromoiodide emulsions for recording blue, green and red exposures and the second interlayer unit is chosen to absorb blue light during imagewise exposure.

15. A silver halide photographic element according to claim 2 wherein the emulsion layer units are comprised of silver bromoiodide emulsions for recording blue, green and red exposures and the second interlayer unit is chosen to reflect blue light during imagewise exposure.

16. A photographic element according to claim 2 wherein at least one said interlayer unit containing means for reflecting is a composite interlayer unit comprised of a reflective sub-layer and an absorptive sub-layer, the absorptive sub-layer being positioned nearer the support than the reflective sub-layer when the support is a reflective support.

17. A silver halide photographic element capable of being scanned for image information following imagewise exposure and photographic development and fixing comprised of a support and, coated on the support, a sequence of blue, green and red recording silver bromoiodide emulsion layer units at least two of which are capable of producing images of the same hue after processing, the red recording silver bromoiodide emulsion layer unit being coated nearer to the support than the remaining emulsion layer units, a first interlayer unit coated over the red recording emulsion layer unit comprised of means for transmitting specular light to the red recording emulsion layer unit during imagewise exposure and, after photographic development and fixing, reflecting light in a scanning wavelength region, the green recording silver bromoiodide emulsion layer unit being coated over the first interlayer unit, a second interlayer unit coated over the green recording emulsion layer unit comprised of means for transmitting specular light to the green and red recording emulsion layer units during imagewise exposure and absorbing or reflecting blue light during imagewise exposure and after photographic development and fixing, and the blue recording silver bromoiodide emulsion layer unit being coated over the second interlayer unit.

18. A photographic element according to claim 17 wherein the support is comprised of means for rendering the support transparent after photographic processing, the first interlayer unit consists of a reflective sub-layer capable of reflecting green light and an absorptive sub-layer capable of absorbing green light, and the reflective sub-layer is located nearer the red recording emulsion layer unit than the absorptive sub-layer.

19. A photographic element according to claim 18 wherein the second interlayer unit consists of a reflective sub-layer capable of reflecting green light and an absorptive sub-layer capable of absorbing blue light and the reflective sub-layer of the second interlayer unit is located nearer the blue recording emulsion layer unit than the absorptive sub-layer of the second interlayer unit.

20. A silver halide photographic element capable of being scanned for image information following imagewise exposure and photographic development and fixing comprised of a support and, coated on the support, a sequence of blue, green and red recording silver halide emulsion layer units at least two of which are capable of producing images of the same hue after processing, the blue recording emulsion layer unit containing at least one blue sensitized silver halide emulsion coated nearer to the support that any remaining silver halide emulsion layer unit, a first interlayer unit coated over the blue recording emulsion layer unit comprised of means for transmitting specular light to the blue recording emulsion layer unit during imagewise exposure and, after photographic development and fixing, reflecting light in a scanning wavelength region, the red recording emulsion layer unit containing at least one red sensitized silver halide emulsion chosen to exhibit minimal sensitivity to the blue region of the spectrum coated over the first interlayer unit, a second interlayer unit coated over the red recording emulsion layer unit comprised of means for transmitting specular light to the blue and red recording emulsion layer units during imagewise exposure and, after photographic development and fixing, absorbing or reflecting light in a scanning wavelength region, and the green recording emulsion layer unit containing at least one green sensitized silver halide emulsion chosen to exhibit minimal sensitivity to the blue region of the spectrum coated over the second interlayer unit.

* * * * *